US005476581A

United States Patent [19]

Reckeweg et al.

[11] Patent Number: 5,476,581

[45] Date of Patent: Dec. 19, 1995

[54] METHOD OF PRODUCING A WEAPON BARREL HAVING A WEAR-RESISTANT INNER COATING

[75] Inventors: Horst Reckeweg, Heiligenhaus; Gert Schlenkert, Düsseldorf; Siegmar Kukulies, Erkrath, all of Germany

[73] Assignee: Rheinmetall GmbH, Ratingen, Germany

[21] Appl. No.: 323,250

[22] Filed: Oct. 17, 1994

[30] Foreign Application Priority Data

Oct. 15, 1993 [DE] Germany ..... 43 35 139.5

[51] Int. Cl.[6] ..... C25D 5/02; C25D 5/04; C25D 5/34; C25D 7/04

[52] U.S. Cl. ..... 205/122; 205/131; 205/135; 205/151; 205/206; 205/210; 205/217; 205/218; 205/219

[58] Field of Search ..... 205/122, 131, 205/135, 151, 206, 210, 219, 115, 217, 218

[56] References Cited

U.S. PATENT DOCUMENTS

| | | | |
|---|---|---|---|
| 2,395,044 | 2/1946 | Gorton | 42/76 |
| 2,687,591 | 8/1954 | Lamb et al. | 42/76 |
| 4,711,705 | 12/1987 | Martyak et al. | 204/34 |

FOREIGN PATENT DOCUMENTS

| | | |
|---|---|---|
| 0084752A1 | 3/1983 | European Pat. Off. . |
| 2045738 | 3/1972 | Germany . |
| 524036 | 7/1940 | United Kingdom . |

OTHER PUBLICATIONS

Moretti, Advantages of Thick Hard Chromium Plating Applied to [Small–Bore] Firearms, Gawanotecnica, 21(10), pp. 209–212 (1970) no month.

*Primary Examiner*—John Niebling
*Assistant Examiner*—Edna Wong
*Attorney, Agent, or Firm*—Spencer, Frank & Schneider

[57] ABSTRACT

A method of producing a weapon barrel (1) having a wear-resistant inner coating (10) applied by an electrolytic method. To enable the application of a relatively thick protective layer to the inner wall or surface of a large-caliber weapon barrel (1), in particular, in the regions of thermally high stress and in a simple manner, a weapon barrel (1) prefabricated true to caliber is provided, a recess (7) is formed in the region of the chamber (2) and of the adjoining caliber region (3) to be coated with the protective layer (10) by electrochemical stripping (electrolytic polishing), and the recess (7) is subsequently refilled electrolytically with the protective layer (10). The same center electrode (4, 12) preferably is used for the electrolytic polishing process and for the electrolytic process for applying (plating) the protective coating or layer (10).

9 Claims, 2 Drawing Sheets

METHOD OF PRODUCING A WEAPON BARREL HAVING A WEAR-RESISTANT INNER COATING

REFERENCE TO RELATED APPLICATIONS

This application claims the priority of German application Serial No. P 43 35 139.5, filed Oct. 15, 1993, which is incorporated herein by reference.

BACKGROUND OF THE INVENTION

The invention relates to a method of producing a weapon barrel having a wear-resistant inner coating, applied by an electrolytic process, to the region of the chamber and of the adjoining, thermally highly-stressed caliber portion of the weapon barrel.

To achieve an improved service life of weapon barrels, it is known to provide same with a protective layer or coating. Electrolytically-applied chromium has proven particularly effective as a protective layer or coating, although other materials, such as nickel, cadmium and silver, likewise are used as a protective layer.

U.S. Pat. No. 2,395,044, for example, discloses a weapon barrel in which the chamber and the region of the initial caliber portion adjoining the chamber are coated with a chromium layer to reduce erosion. In this instance, the layer or coating thickness of the chromium in the region of the chamber is within a size range of approximately 10 μm, and decreases toward the muzzle of the gun barrel.

However, in large-caliber barrels, e.g. in weapon barrels having a caliber of 155 mm, such small thicknesses of the protective layer in the region of the chamber do not effect a sufficient improvement in service life over uncoated weapon barrels. Rather, it has been found that, in this type of weapon barrel, layer thicknesses in the order of magnitude of 100–200 μm are necessary. However, up to now the electrolytic application of appropriate layer thicknesses has required expensive and/or complex mechanical pretreatment and after treatment of the weapon barrel.

Furthermore, a weapon barrel provided with a protective layer is known from U.S. Pat. No. 2,687,591. In this case, the thickness of the protective layer increases toward the muzzle. Such weapon barrels have not performed well, at least in large-caliber barrels, because the highest thermal stresses of the weapon barrel occur at the inlet to the caliber portion of the barrel, i.e. at the transition from the cartridge chamber to the rifling grooves, and the protective layer must also be the thickest in this region. Moreover, experiments performed by Applicant have revealed that the protective layer or coating is frequently destroyed in the forward region of the weapon barrel because of the severe mechanical stresses, and these locations then lead to gas leakage and turbulence, which in turn can be conducive to erosion.

Finally, a weapon barrel for machine guns is known from German laid open patent application No. DE-OS 2 045 738 in which a protective layer or coating of the weapon barrel is omitted, and instead at least two exchangeable, wear-resistant bushings are used in the region under the highest thermal stress (chamber and initial caliber region of the barrel). The use of such bushings is relatively costly, because corresponding pre-turned and gas-tight fixings for the bushings must be provided in the weapon barrel. Use of this type of bushing in large-caliber weapon barrels has therefore not been generally accepted.

It is therefore an object of the present invention to disclose a method of producing a weapon barrel provided with a protective layer which is simple to produce and which withstands the high thermal stresses in the region of the chamber and of the initial caliber portion, particularly also in large-caliber weapon barrels.

SUMMARY OF THE INVENTION

The above object generally is achieved according to the present invention a method of producing a metal weapon barrel having a wear-resistant metal inner coating, applied by an electrolytic process, to the region of the chamber and of the adjoining, thermally highly-stressed caliber portion of the weapon barrel which comprises: providing a weapon barrel prefabricated true to caliber; electrolytically polishing the inner surface of the gun barrel in the region of its chamber and of the adjoining, thermally highly-stressed caliber portion to strip as much of the metal material of the weapon barrel from the region to be provided with the protective coating as is subsequently to be re-applied as the protective metal coating and to form a recess; and subsequently electrolytically plating the protective metal coating on the region to substantially replace the stripped quantity of metal and to substantially fill the recess. Particularly advantageous embodiments and modifications of the invention likewise are disclosed.

Therefore, the essential concept underlying the invention is, in a weapon barrel prefabricated true to caliber, to provide the region of the chamber and of the adjoining caliber region to be provided with the protective layer or coating with a recess through the use of electrochemical stripping (electrolytic polishing) and to subsequently substantially refill this recess electrolytically with the protective coating or layer. The same electrode is preferably used for the electrolytic polishing process and for the electrolytic plating process of applying the protective layer.

With the method according to the invention, it is possible in a simple manner to provide the weapon barrel with relatively thick protective layers of 100 to 200 μm without it being necessary to perform a mechanical after treatment or an expensive and/or complex mechanical stripping of the barrel material prior to the application of the protective layer.

Based on the different properties of the electrolytic polishing and plating electrolytes, particularly chromium-plating electrolytes, and thus of the different field distribution in the electrolytes, it must be considered that the electrode position may have to be changed during the transition from electrolytic polishing to electrolytic-plating in order to assure a smooth transition of the protective layer or coating in the caliber region.

Further details and advantages of the invention ensue from the embodiments described below through the use of the drawing figures.

DETAILED DESCRIPTION OF THE PREFERRED EMBODIMENT

Figure 1:
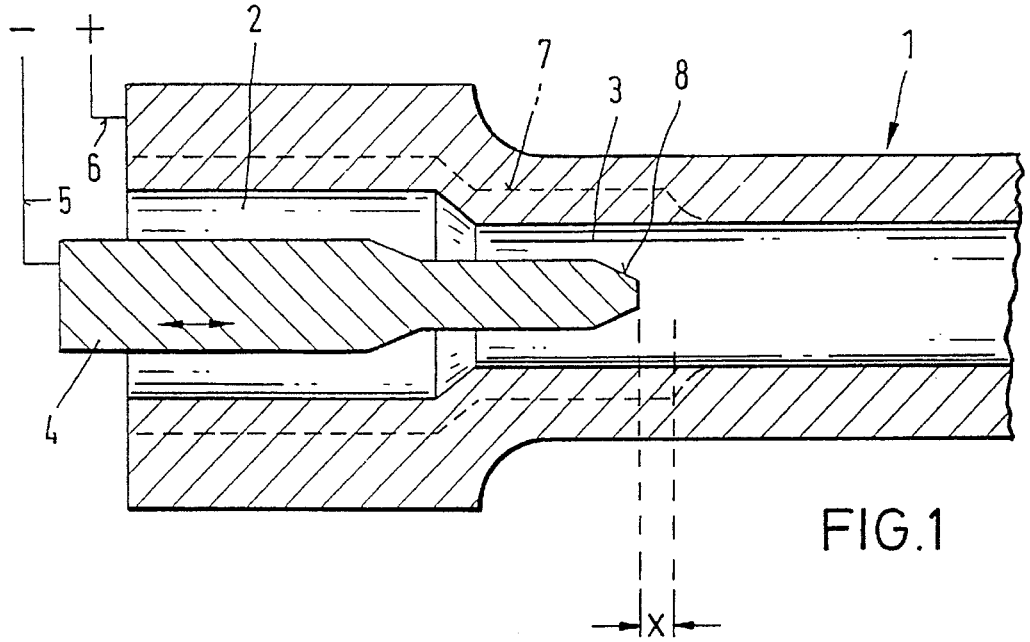
FIG. 1 a schematic cross-section of a part of a weapon barrel to be provided with a wear-resistant metal, preferably chromium, layer, prior to the electrolytic polishing process of the method according to the invention.

In FIG. 1, the chamber-side part or breech end of a weapon barrel is indicated by reference numeral 1, the cartridge chamber is indicated by reference numeral 2, and the initial caliber portion of the weapon barrel adjoining the chamber is indicated by reference numeral 3. An electrode 4, which is connected to a current source, not shown, by an electrical line 5, projects axially into chamber 2 and initial caliber portion 3. The electrode 4 preferable has a shape, as shown, which corresponds to the inner shape of the weapon barrel 1 adjacent to the electrode 4. Weapon barrel 1 is likewise connected to the current source via a line 6, and forms an anode during the electrolytic polishing process, and a cathode during the electrolytic-plating process, e.g., of chromium.

Prior to the start of the electrolytic polishing process, weapon barrel 1 first is degreased in a manner well known per se. After degreasing, weapon barrel 1 is placed in a container, and a corresponding electrolyte solution, e.g. a phosphoric acid/sulfuric acid mixture, flows through the barrel 1. The cathode 4 is placed axially and appropriately positioned in the breech end of the weapon barrel and is subsequently connected to a current source via line 5, and weapon barrel 1 is connected to the current source via line 6. The electrolytic polishing process is now performed until as much material of weapon barrel 1 is stripped from the region to be coated as is to be applied during the subsequent electrolytic-plating process. FIG. 1 shows the corresponding recess which results from the stripping of the weapon barrel material by a dashed line, which is provided with the reference numeral 7.

The shape of electrode 4 determines the profile of recess 7, and can have a forward region 8 which is, for example, cone-shaped (to effect a recess 7 which approximately tapers toward the inner barrel wall), cylindrical, ball-shaped or curved.

Figure 2:
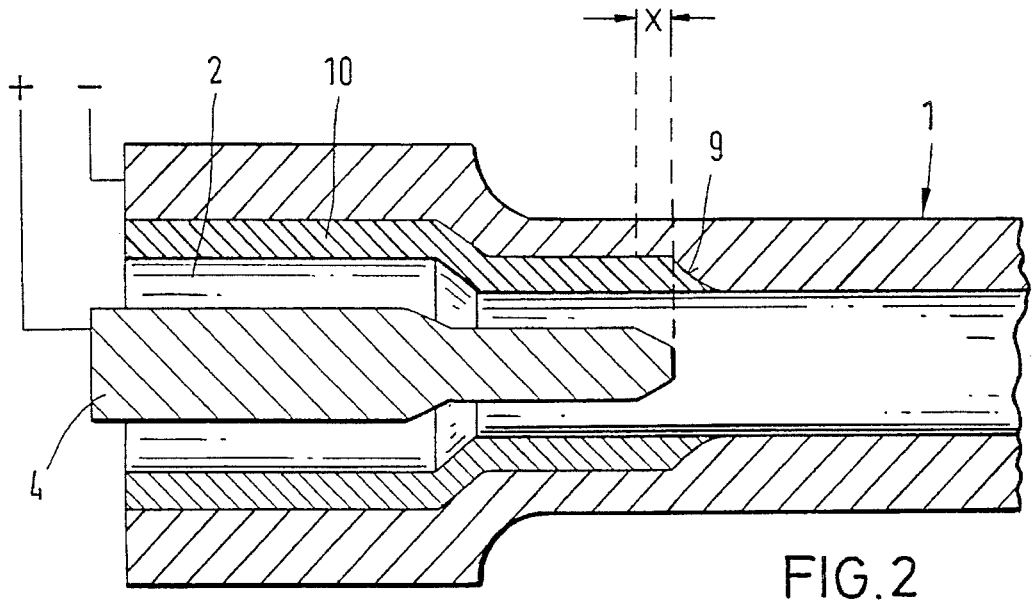
FIG. 2 is a schematic a cross-sectional view of the weapon barrel illustrated in FIG. 1, following the electrolytic-plating process of the method according to the invention.

Following electrolytic polishing, electrolytic-plating of the wear resistant metal takes place by means of the electrolytic depositing of the metal, preferably chromium, on the surface of recess 7 of weapon barrel 1 to substantially refill the recess. In this process, sulfuric chromic acid, for example, can be used as the electrolyte for depositing chromium. In accordance with the preferred embodiment of the invention, the electrode 4 used as the cathode during the electrolytic polishing process is now used as the anode during the electrolytic plating process (see FIG. 2). However, it has been found that the electrolytic polishing electrolyte and the electrolytic-plating electrolyte for the wear-resistant metal, preferably chromium, have strikingly different dispersion properties. Therefore, the electrolytically-polished region 7 cannot be completely filled with the wear-resistant metal if the anode is maintained in the same position during the plating as when utilized during the electrolytic polishing. In this type of situation, rather, a trough-shaped depression results in the region 9 of the tapering metal layer or coating 10 in the region of the beginning of the caliber portion 3 (not shown).

In accordance with the invention, this trough can be significantly reduced if electrode (anode) 4 is displaced by a predetermined amount "x" toward the muzzle of the weapon barrel during metal (chromium) plating. A nearly smooth transition from metal layer 10 to the adjoining barrel wall or inner surface is attained when the electrolytic-plating process is effected in at least two partial steps. For this purpose, following electrolytic polishing, anode 4 is displaced toward the muzzle of weapon barrel 1 by a predetermined amount (FIG. 2), and left in this position for a predetermined period of time for electrolytic-plating. Subsequently, anode 4 is returned to the position in which the electrolytic polishing took place (FIG. 1), for example after one-half the processing time, and is further plated with the wear-resistant metal, preferably chromium. The displacement of anode 4 toward the front and from the front position the rear position can also be performed in a plurality of steps or continuously.

Figure 3:
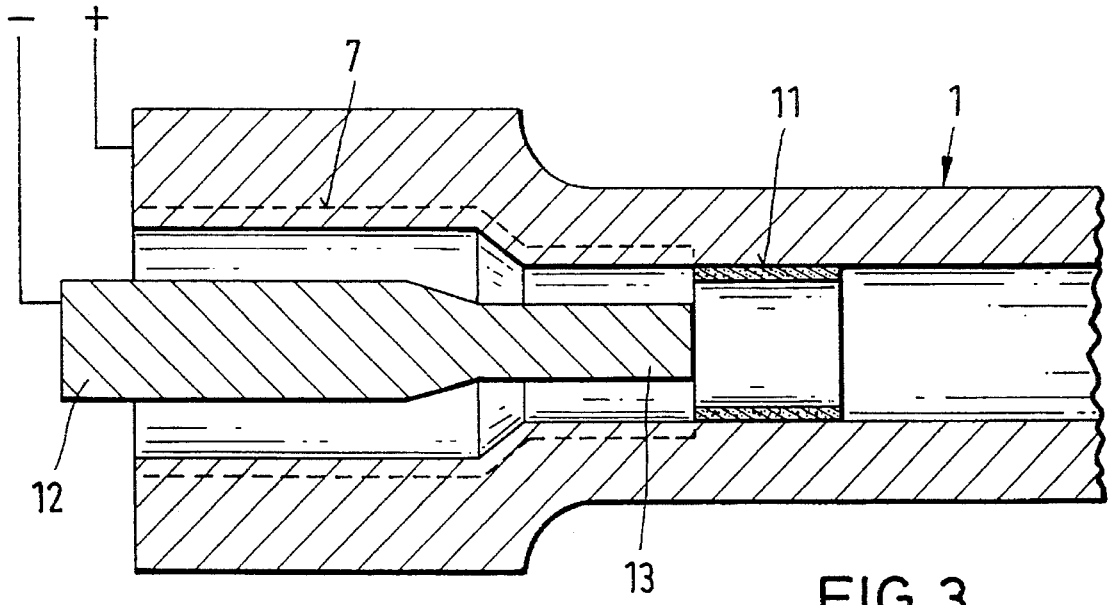
FIG. 3 is a schematic cross-sectional view of the weapon barrel illustrated in FIG. 1 provided with a lacquer or varnish layer to limit the electrolytic polishing and electrolytic-plating region, according to a modification of the method according to the invention.

FIG. 3 shows an embodiment in which a distinct transition can be obtained between the coated and uncoated weapon regions by covering the region of weapon barrel 1 that is not to be chromium-plated with a corresponding lacquer or varnish layer 11. Correspondingly, the recess 7 produced by the electrolytic polishing process is nearly rectangular at its caliber-side or forward end. In this case, electrode 12, as shown in FIG. 3, can also be cylindrical. Moreover, lacquer or varnish layer 11 need not extend up to the barrel muzzle, but only far enough to ensure that anode 12 will not effect any more metal (chromium) coating on weapon barrel 1 on the muzzle side. However, it can be simpler, in terms of method technology, to use a corresponding lacquer or varnish to cover everything in the barrel that is not to be plated later. NOLAN, produced and sold by the firm of Schering KG, has proven particularly effective for use as the covering lacquer or varnish layer 11.

The invention now being fully described, it will be apparent to one of ordinary skill in the art that any changes and modifications can be made thereto without departing from the spirit or scope of the invention as set forth herein.

What is claimed:

1. A method of producing a metal weapon barrel having a wear-resistant metal inner protective coating applied, by an electrolytic process, to the region of a chamber of the weapon barrel and of an adjoining, thermally highly-stressed caliber portion of the weapon barrel, said method comprising: providing a weapon barrel prefabricated true to caliber; electrolytically polishing an inner surface of the weapon barrel in the region of its chamber and of the adjoining, thermally highly-stressed caliber portion to strip as much of the metal material of the weapon barrel from said region to be provided with the protective coating as corresponds to metal subsequently to be applied as the protective metal coating, and to thus form a recess; and, subsequently electrolytically plating the protective metal coating on said region to substantially replace the stripped quantity of metal and to substantially fill the recess; and, wherein: said electrolytically polishing and electrolytically plating steps each includes positioning an electrode, having a forward end which is one of cylindrical, cone-shaped, ball-shaped or curved, in the weapon barrel adjacent said region to receive the protective coating, and using the electrode required for electrolytically polishing as an anode for electrolytically plating the weapon barrel; a forward portion of the recess has a forwardly inwardly tapering region; and the electrolytically plating step further includes displacing the forward region of the electrode such that a smooth transition results between a tapering region of the protective coating and the inner surface of the weapon barrel.

2. A method as defined in claim 1, wherein said step of displacing the forward region of the electrode during electrolytic plating includes initially moving the electrode forward, from a first position corresponding to its position during electrolytic polishing, for a desired distance and for a desired period of time, and then returning the electrode to said first position.

3. A method as defined in claim 2 wherein the electrode is displaced continuously during electrolytic plating.

4. A method as defined in claim 2, wherein the electrode is displaced in discrete steps during electrolytic plating.

5. A method as defined in claim 2, wherein said desired period of time is approximately one half of the total plating time.

6. A method as defined in claim 1, further comprising covering at least the portion of the inner surface of the weapon barrel immediately in front of said region to be provided with the protective coating with a lacquer layer prior to electrolytic polishing of the inner surface of the weapon barrel.

7. A method as defined in claim 6, wherein a forward region of the electrode is cylindrical with a flat forward end.

8. A method as defined in claim 1, wherein the metal plated on the inner surface of the weapon barrel during the electrolytic plating is chromium.

9. A method as defined in claim 1, wherein a material layer between 100 and 200 μm is stripped from said region of the inner surface of the weapon barrel by the electrolytically polishing step.

* * * * *